United States Patent [19]

Gallina et al.

[11] 4,178,821

[45] Dec. 18, 1979

[54] CONTROL SYSTEM FOR AN ELECTRONIC MUSIC SYNTHESIZER

[75] Inventors: Salvatore Gallina; Stan Davidson, both of New York, N.Y.

[73] Assignee: M. Morell Packaging Co., Inc., New York, N.Y.

[21] Appl. No.: 705,120

[22] Filed: Jul. 14, 1976

[51] Int. Cl.[2] ..... G10H 1/02; G10H 5/00

[52] U.S. Cl. ..... 84/1.01; 84/1.24; 84/445

[58] Field of Search ..... 84/1.01, 1.11, 1.19, 84/1.24, 455, DIG. 2, DIG. 8, DIG. 20

[56] References Cited

U.S. PATENT DOCUMENTS

| | | | |
|---|---|---|---|
| 3,515,792 | 6/1970 | Deutsch | 84/1.24 X |
| 3,610,799 | 10/1971 | Watson | 84/1.01 |
| 3,610,800 | 10/1971 | Deutsch | 84/1.01 |
| 3,767,833 | 10/1973 | Noble et al. | 84/1.01 |
| 3,786,166 | 1/1974 | Mieda | 84/1.01 |
| 3,828,110 | 8/1974 | Colin | 84/1.01 |
| 3,831,015 | 8/1974 | Hoff, Jr. | 84/1.01 X |
| 3,948,137 | 4/1976 | Niinomi | 84/1.01 |
| 3,986,423 | 10/1976 | Rossum | 84/1.01 |
| 4,073,209 | 2/1978 | Whittington et al. | 84/1.24 |

*Primary Examiner*—Stanley J. Witkowski
*Attorney, Agent, or Firm*—Auslander & Thomas

[57] ABSTRACT

A control system for an electronic music synthesizer includes a circuit responsive to the keying of a musical instrument for producing a binary coded signal. This signal is converted to an analog signal, for application to a music synthesizer. The analog voltage may be modified, for transposition or for portamento effects. The coding circuit may produce trigger and gate voltages for the synthesizer, whereby blowing of the musical instrument, if a wind instrument is employed, is not necessary. Alternatively, the trigger and gate pulses for the synthesizer may be developed from the output of the transducer coupled to the instrument.

11 Claims, 13 Drawing Figures

FIG.1
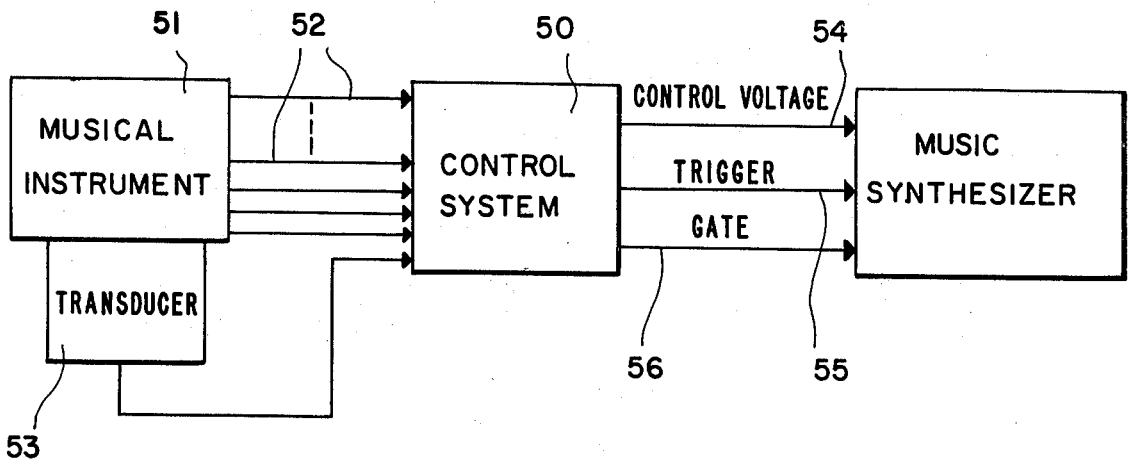
FIG.2
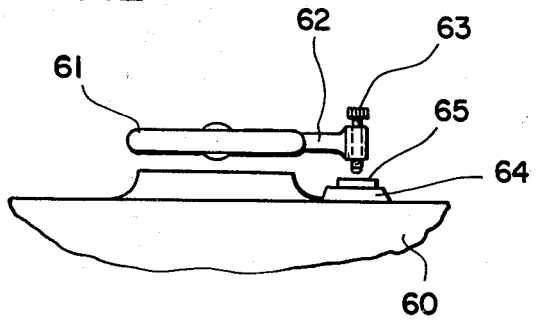
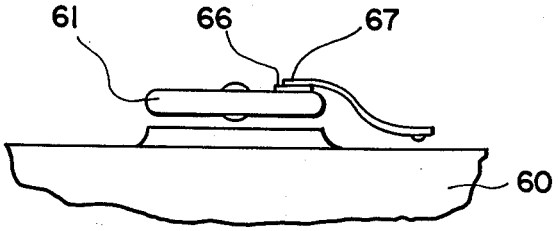
FIG.3

FIG. 12
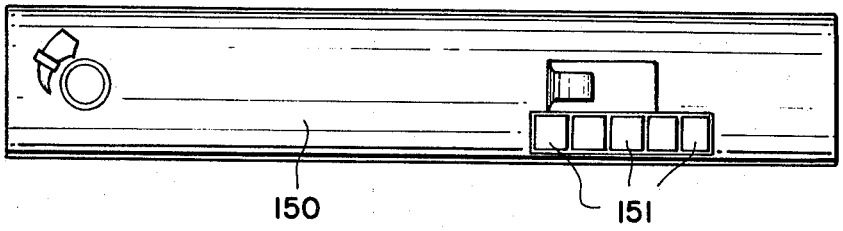
FIG. 9
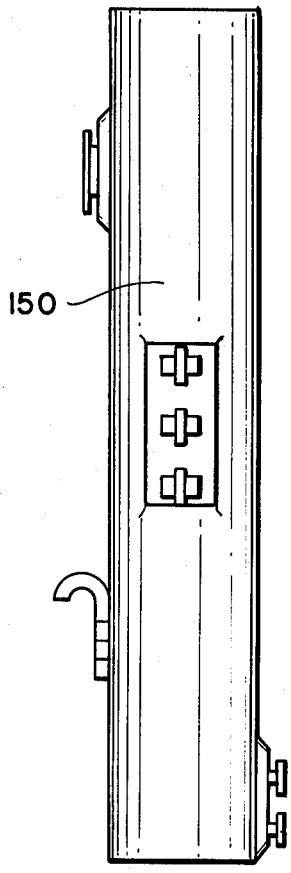
FIG. 10
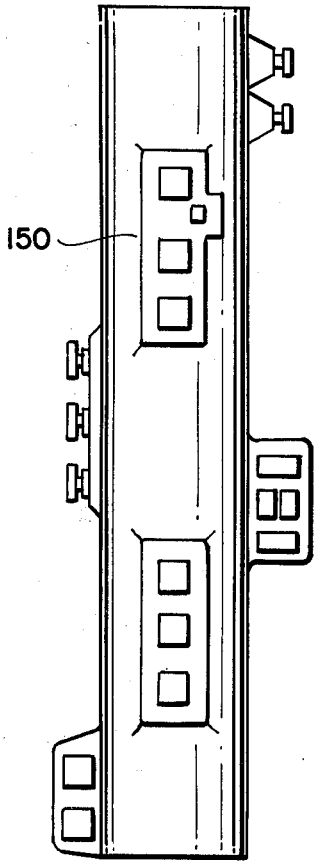
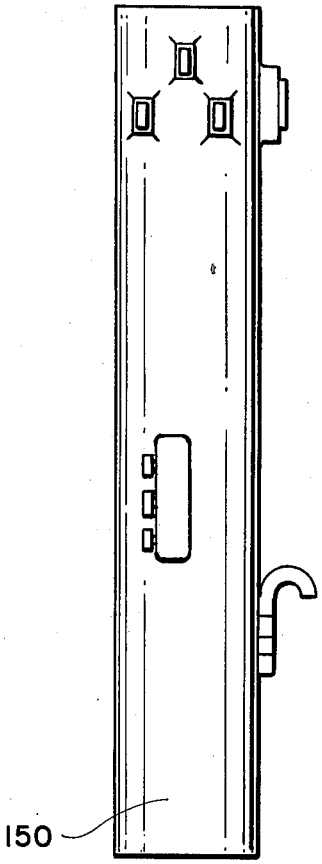
FIG. 11

CONTROL SYSTEM FOR AN ELECTRONIC MUSIC SYNTHESIZER

This invention relates to the electronic synthesis of music, and more in particular, to a system for controlling a conventional music synthesizer in response to the output of a musical instrument especially a wind instrument such as a saxophone.

Music synthesizers are conventionally known, which include a voltage variable oscillator responsive to an input control voltage for producing an audio output. Such synthesizers, in addition to the control voltage proportional to the tone of the desired output, also requires a trigger voltage for initiating an output audio signal as well as a gate voltage for controlling a duration of the audio output.

In order to control such synthesizers, in the past, various keying systems have been employed, connected to a musical instrument, for producing an analog voltage for controllng the music synthesizer. For example, in one conventional system, switches connected to the pads of a wind instrument have been connected by way of resistance networks to directly produce an analog control voltage.

The present invention is directed to an improved control system, responsive to the output of a musical instrument, for controlling the music synthesizer, whereby the synthesizer may be controlled either in response to simultaneous blowing and keying of the instrument, or in response to the keying of the instrument. In addition, the system in accordance with the invention enables the provision of desired control features, such as transposition, portamento effects and octave changing.

Briefly stated, in accordance with the invention, the system in accordance with the invention comprises a binary coded system having an input connectable to the musical instrument, for example, to switches mechanically coupled to the different keys of the instrument. The digital coded signal is employed to produce gate and triggering signals as well as to control a digital to analog converter. The analog voltage produced in the converter may be modified as desired, for example, to produce portamento effect. In addition, the level of the analog voltage may be controlled to effect transposition of the output signal of the synthesizer, or alternatively, to change the octave range. Since a trigger and gate signals are derived in the coding circuit, the synthesizer may even be controlled purely in response to the keying of the instrument.

Alternatively, a transducer may be provided, coupled to the instrument, whereby the production of gate and trigger signals is responsive to the blowing of the instrument rather than just to keys of the instrument.

In order that the invention will be more clearly understood, it will now be described in greater detail, with reference to the accompanying drawings, wherein:

FIG. 1 is a block diagram of the basic system of the invention;

FIG. 2 is a simplified drawing of one technique for providing a switch on a key or pad of a musical instrument;

FIG. 3 is a simplified sketch of a modification of the arrangement of FIG. 2;

FIGS. 9–12 are simplified front, right side, left side and back views respectively, of a simulated musical instrument that may be employed in combination with the control system of the invention.

Figure 4:
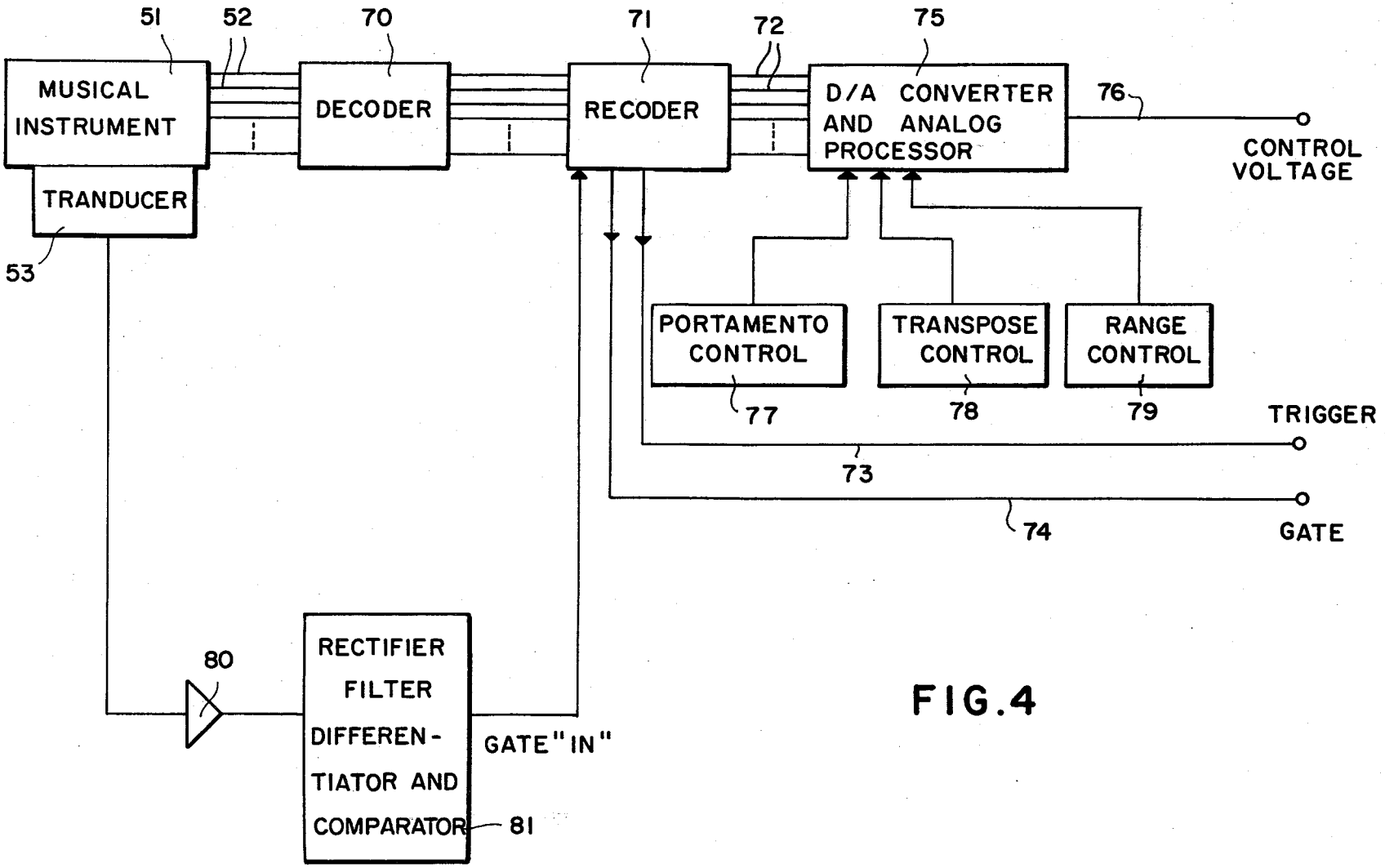
FIG. 4 is a more detailed block diagram of the system in accordance with one embodiment of the invention.

Referring now to the drawings, and more in particular to FIG. 1, therein is illustrated a control system 50 in accordance with the invention. The control system 50 is connected to a musical instrument 51, such as a saxophone or the like, by way of a plurality of leads 52 each corresponding to a separate pad of the instrument. In addition, the control system 50 may be connected to the output of a transducer 53 coupled to receive the acoustic output of the musical instrument.

The control system 50 produces an output control voltage on line 54 that is proportional to the frequency of the musical tone to be sounded, as well as the trigger voltage on line 55 indicating the time at which the tone outputs of the synthesizer should start, and a gate voltage on line 56 corresponding to the duration and/or amplitude of the audio signal produced by the synthesizer.

The system in accordance with the invention is preferably employed in combination with a wind instrument, such as a saxophone or the like. It will be apparent, of course, that the system may alternatively be employed in combination with an instrument which is not blown, i.e., merely has keys. In addition, as will be apparent, in the following paragraphs, the control system may also be employed in combination with a simulated wind instrument, which merely is provided with keys or pads, and does not have a reed or the like to permit it to independently produce musical sounds.

FIG. 2 illustrates one arrangement whereby the key or pads of the wind instrument may be employed as a switch. For example, FIG. 2 illustrates a simplified form of a portion of a saxophone 60 having a conventional pad 61. The pad 61 is provided with an extension 62 through which an adjustable contact screw 63 extends. An insulating layer 64 is provided on the body of the saxophone adjacent to the pad 61, and a conductive plate 65 is provided on the surface of the insulation layer 64. The screw 63 is positioned to engage the plate 65 when the pad is depressed. The plate 65 is adapted to be connected by conventional means to the control system of the invention. It will of course be apparent that each pad is provided with an arrangement such as illustrated in FIG. 2, whereby each plate 65 may be connected to a separate input of the control system. In this arrangement, the metallic body of the instrument, which is connected to the screw 63, provides a common return for the electric circuit.

In a modified arrangement, as illustrated in FIG. 3, an insulating layer 66 is provided on the pad 61, and a contact 67 is affixed to the insulating layer 66. The contact 67 is shaped to extend beyond the pad, to contact the body of the instrument when the pad is depressed. In this instance, the contact 67 is adapted to be connected to the input of the control system, with the body of the instrument providing the common return as in the arrangement of FIG. 2.

Referring now to FIG. 4, therein is illustrated a block diagram showing, in greater detail, a system in accordance with one embodiment of the invention. In the arrangement of FIG. 4, the output leads 52 of the instrument are connected to the decoder 70 for producing a binary coded signal responsive to the depression of the keys of the instrument. The output of the decoder 70 is applied to the recoder 71, for producing a digitally coded output signal on leads 72 that is adaptable to conversion into analog form. In addition, the recoder produces the trigger output on lead 73, and the gate output on lead 74. The output leads 72 of the recoder 71 are applied to a digital to analog converter and analog processor 75, for producing the control voltage on lead 76. The level of the output of the converter 75 may be controlled in response to a portamento control 77, a transpose control 78, and a range control 79 for controlling the octave.

In the system of FIG. 4, the output of the transducer 53 is amplified in amplifier 80, and applied to a rectifier, filter, differentiator and comparator 81, for producing a gate voltage "in" signal, for application to the recoder 71. When the musical instrument 51 is in the "no blow" mode, i.e., is not to be controlled in response to blowing, the trigger and gate signals are produced directly in response to the keying of the instrument. In the "blow" mode, however, when the synthesizer is to be controlled in response to blowing of the instrument, the gate "in" signal, responsive to the blowing of the instrument, is applied to control the production of the trigger and gate signals by the recoder 71.

Figure 5:
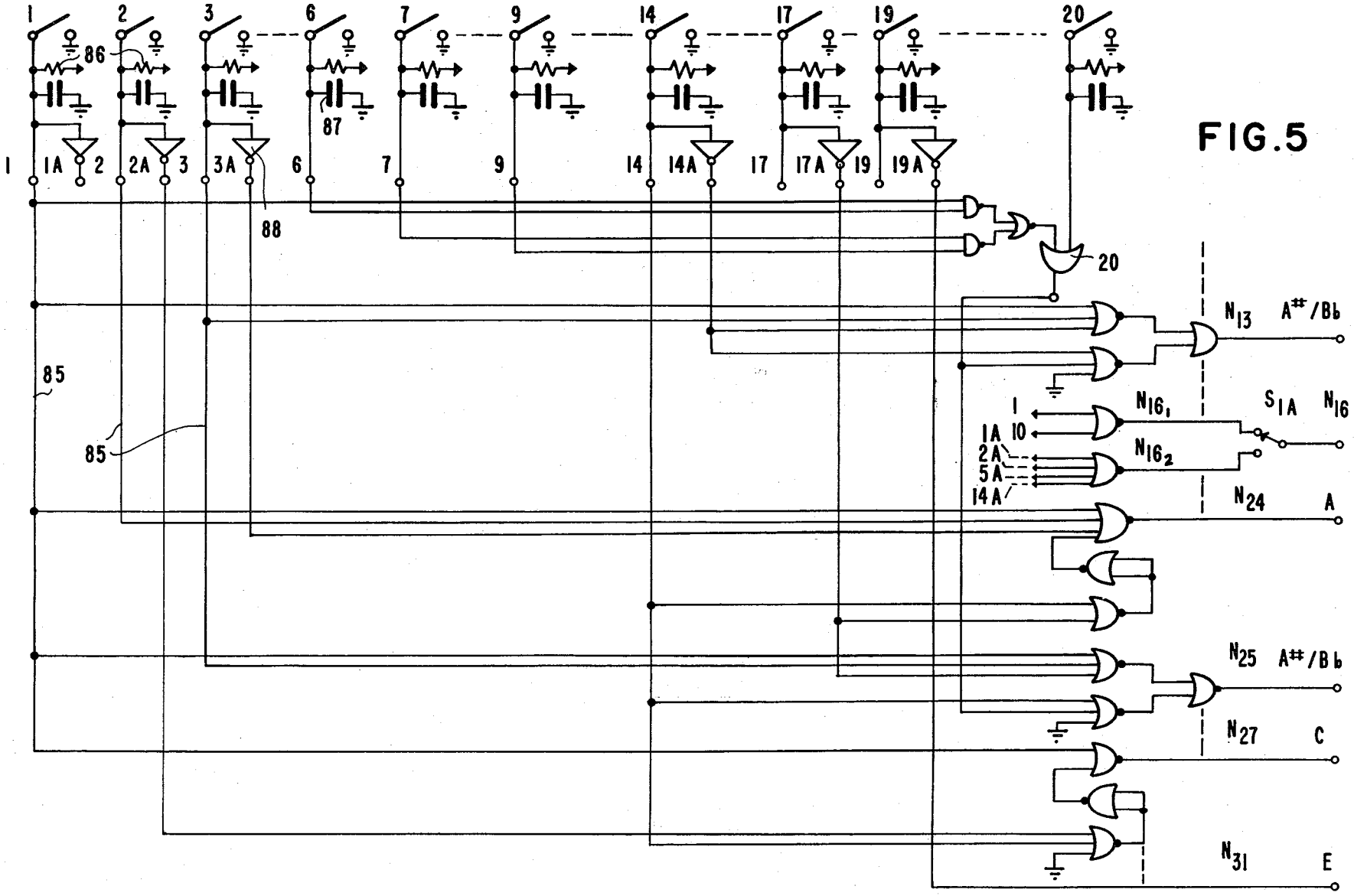
FIG. 5 is a more detailed circuit diagram of the decoder of the system of FIG. 4.

FIG. 5 illustrates the decoder portions of the control system of FIG. 4, in combination with a representative number of pads, or switches, of the musical instruments. In the arrangement of FIG. 5, the pads 1–20 correspond to the pads of a saxophone. The pads, when depressed, are adapted to ground the output leads 85 connected to the pads. Each pad is connected to a source of potential, for example, 15 volts, by way of a resistor 86, for example, a 10,000 ohm resistor. In addition, a capacitor 87 is connected between each pad and ground. Further, with respect to certain of the pads, an inverter 88 is connected to provide an inverter signal, whereby the outputs of the inverters constitute an inversion of the outputs at the terminals 1–20 connected to the respective pads of the same reference numeral. Thus, the terminals 1A–19A are the inverted form of the signals at terminals 1–19 respectively. As above discussed, an inverter is not necessary with respect to each pad. The terminals 1–20 and 1A–19A are connected via logic gates to output terminals N1–N39, in accordance with Table 1 as follows, whereby the outputs at their terminals N1–N39 correspond to the keys also illustrated in Table 1. Since some of the interconnections of the pads and the terminals N are more complicated, the specific interconnections of such output terminals are illustrated more clearly in FIG. 5. It will of course be apparent that in general, the various outputs of the pads are connected to the output terminals N by way of gates in accordance with Table 1, with the specific interconnection of gates for terminals N13, N16, N24, N25, N27 and N31 being illustrated in FIG. 5, since these interconnections are somewhat more complex than the remainder and are more easily understood from a graphical presentation. In addition, terminals N35–N39 are connected directly to the respective pad terminals, as illustrated in Table 1, without the interposition of any gates.

In the arrangement of FIG. 5, the grounding of a pad shorts the resistor 86 to ground, whereby, when the pad is depressed, the voltage at the pad terminal drops from 15 volts to ground. The depression of the pad of course results in the output of the respective inverters going from 0 to 15 volts. The gates are connected to the pad terminals selectively, so that the outputs at the terminals N1–N39 correspond sequentially to the notes of a scale. In the arrangement of FIG. 5, when an appropriate pad combination is depressed for a given note, the corresponding N output terminals of the decoder goes to a logic high level, and the remainder of the N output terminals are at logic low level.

It will be noted that the N16 terminal is connected to the lines $N16_1$ and $N16_2$ selectively by a switch S1A. This switch is controlled in response to the "blow'-'—"no blow" modes, as will be discussed in greater detail in the following paragraphs. The illustrated position of switch S1A is the "no blow" mode.

Figure 6:
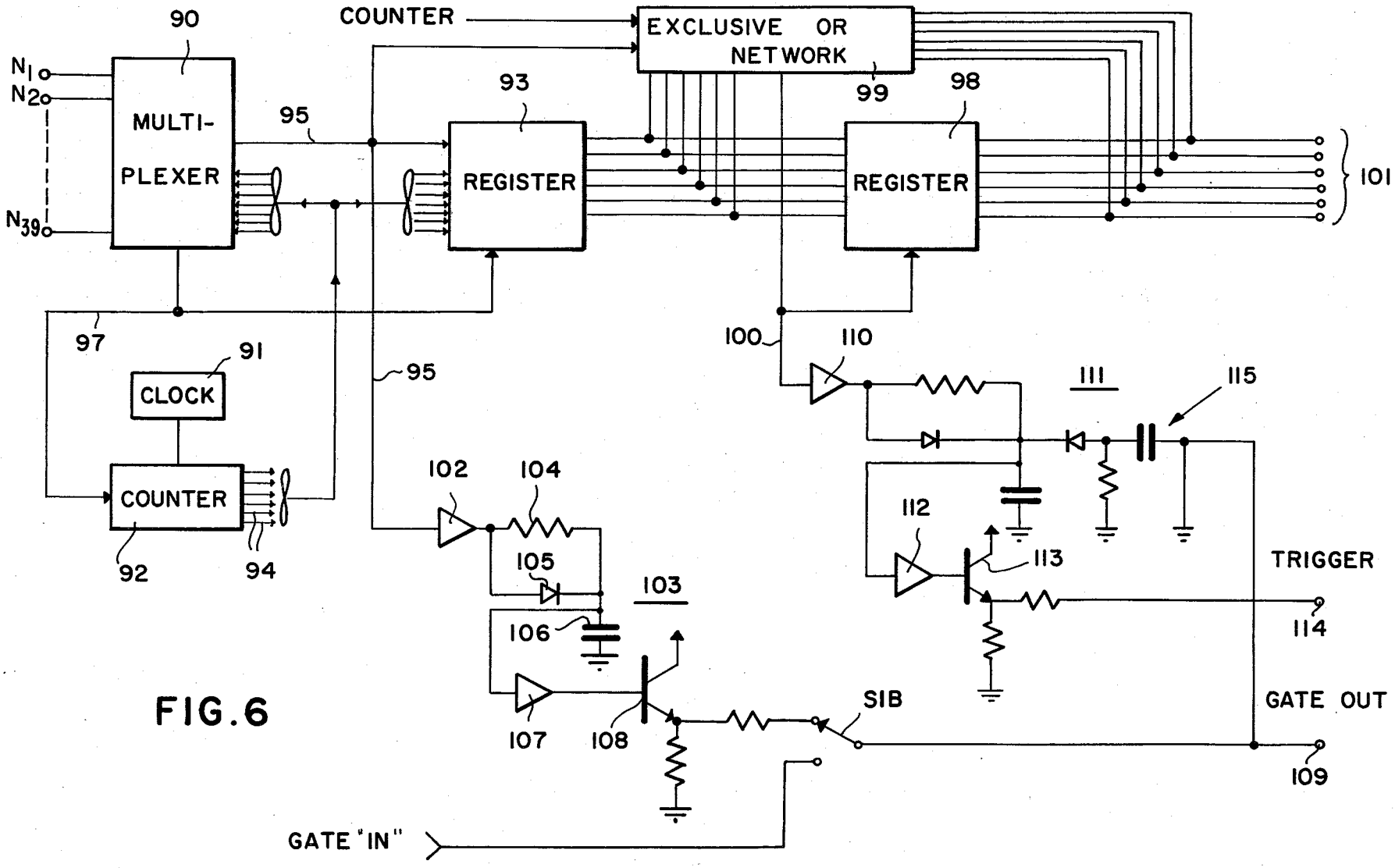
FIG. 6 is a more detailed circuit diagram of the recoder of the system of FIG. 4.

FIG. 6 illustrates in block form the recoder of FIG. 4. In the arrangement of FIG. 6, the output terminals N1–N39 of the decoder are applied separately to a multiplexer 90. The multiplexer 90 may be comprised of a plurality of integrated circuits type CD 4051.

The recoder further comprises a clock 91 adapted to step a counter 92, for example, an integrated circuit type CD 4024. The six output lines 94 of the counter 92 are applied to a register 93, for example, formed of a plurality of integrated circuits type CD 4013. The register 93 constitutes a latch. The output of the counter 92 is also applied to the multiplexer 90 as a scanning signal.

The address applied from the output of the counter 92 to the multiplexer 90 is thereby sequentially scanning the input to the multiplexer 90. When an input terminal N of the multiplexer, corresponding to the output of the counter 92 has a logic low level, no output is produced by the multiplexer. On the other hand, when the address of the output of the counter 92 corresponds to an N terminal having a logic high level, an output will be produced by the multiplexer on line 95 for clocking the latch register 93 and storing therein the corresponding output of the counter 92 occurring at that time. In addition, the multiplexer 90, by way of the output lead 97, effects the resetting of the counter 92. As a consequence, the address, and hence the note, as stored in the register 93 is continually updated to correspond to the depressed pad, and a signal is produced on the line 95 at the output of the multiplexer for indicating each updating of the register 93. It is of course apparent that the register 93 is updated, even though the new data corresponds to the old data stored therein.

In addition, the recoder circuit comprises a register 98, having the same number of stages as the register 93, and it also comprises, for example, a plurality of integrated circuits type CD 4013. The six outputs of the register 93 are connected to the corresponding inputs of the register 98. An exclusive OR network 99 is connected to compare the outputs of the registers 93 and 98. When the output signals do not compare, a signal is produced on the line 100, controlling the register 98 to be updated in accordance with the data stored in the register 93. The output of register 98 on the fixed output lines 101, forms a binary code continually corresponding to the tone to be played by the instrument.

In the arrangement of FIG. 6, in order to produce a key signal corresponding to the duration of the note being played, the output lead 95 of the multiplexer 90 is applied by way of a buffer amplifier 102 to a pulse stretcher 103, formed of a parallel combination of a resistor 104 and diode 105 in series with a capacitor 106. This circuit is connected between the output of the amplifier 102 and ground. The output of the stretcher 103, and the output of the amplifier 102, is applied by way of a buffer amplifier 107 to an emitter follower driver 108. In the "no blow" mode of operation for controlled response to keying of the instrument the gate for the synthesizer, at terminal 109, is directly obtained by way of the switch S1B from the emitter follower 108.

The output of exclusive OR network 99, which occurs at each transition between different notes, is applied by way of a buffer amplifier 110 to a further pulse stretcher 111.

The output of this pulse stretcher 111 is applied by way of a buffer amplifier 112 and an emitter follower driver 113 to a trigger output terminal 114, for application to the music synthesizer. As a consequence, it is apparent that a pulse appears at the output of the trigger terminal 114 at each transition between different notes, whereas a gate appears at the output terminal 109 whenever pads corresponding to a note are depressed.

The gate output terminal 109 is also applied by way of a differentiating circuit 115 to the trigger pulse stretcher 111, so that the trigger pulse may alternatively be derived from the gate output, in the "blow" mode. It will be noted that a gate "in" signal is applied, by way of the switch S1B through the gate output terminal. The gate "in" signal is derived in the "blow" mode, by means that will be disclosed in greater detail in the following paragraphs. It is further to be noted that the switch S1A of FIG. 5 is controlled simultaneously with the switch S1B of FIG. 6.

It is therefore apparent that the decoder circuit, as illustrated in FIG. 5, is employed to decode the output of a musical instrument, so that an output appears at only one of the plurality of output terminals N, with the energized output terminal corresponding to a given specified musical tone. The recoder circuit, as illustrated in FIG. 6, is employed to convert the address of the N terminal to the corresponding 6 bit binary number. The register 98 is employed, in combination with the register 93 and the exclusive OR network 99, in order to debounce the output signal, and the recoder circuit further provides gating and triggering pulses in the "no blow" mode.

The exclusive OR circuit is connected so that if, in the "no blow" mode, no note is played, so that all of the N lines are at low logic level, the register 98 will retain its previous data. If, instead, a new note is played at the end of a counting sequence, its associated binary number will be stored in the register 98. Further, if all of the pads are opened before the operation of the exclusive OR circuit is completed, the register 98 will also retain the last binary code stored therein. When the register 98 must be updated due to lack of coincidence between the data stored in this register and the data stored in register 93, the pulse output on line 100 of the exclusive OR network effects the control of the register 98 to store the data that is currently stored in the register 93.

In the "blow" mode, on the other hand, if all of the pads are opened, a C sharp will result, due to the switching of the switch S1A.

The exclusive OR network 99 may be comprised of a plurality of exclusive OR gates, each having inputs connected to corresponding outputs of the registers 93 and 98. The outputs of the exclusive OR gates may be connected to the inputs of a common NOR gate, the output of the NOR gate being synchronized with the resetting of the counter 92. Alternatively, the exclusive OR network may further comprise a counter responsive to the number of reset pulses applied to the counter 92 following an output of the exclusive OR gates, so that the output pulse on line 100 occurs with a delay from the time the lack of coincidence was first detected. The count of the counter in the exclusive OR network, in order to produce the pulse on line 100, may be set as desired, so that a desired delay occurs in the updating of the register 98 to ensure that there is no bouncing in the output signal. The counter in the exclusive OR network thus counts multiplexer reset pulses following the detection of a state of no coincidence, to provide the desired delay.

Figure 7:
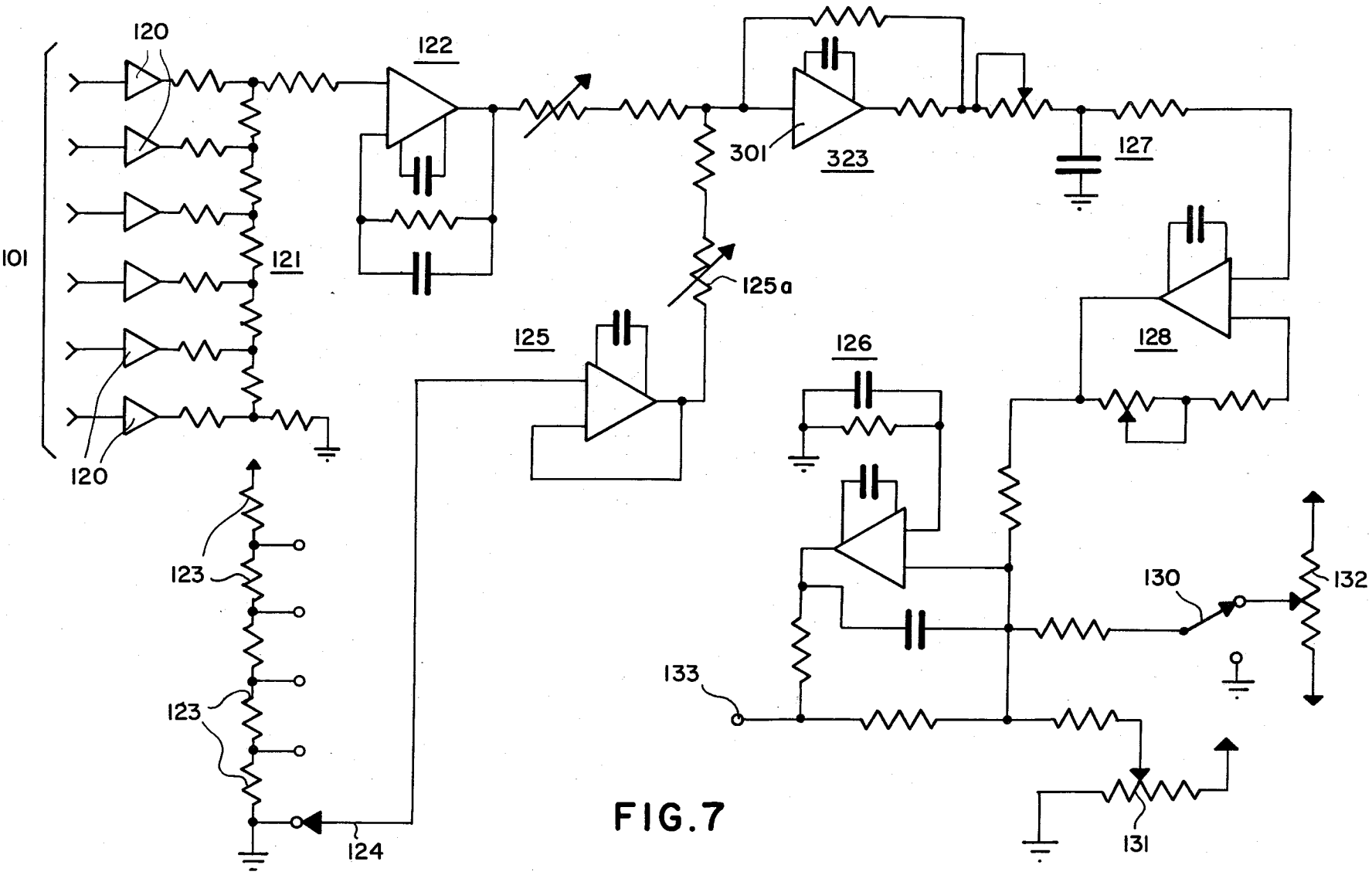
FIG. 7 is a circuit diagram of the digital to analog converter and analog processor of the system of FIG. 4.

FIG. 7 illustrates the digital to analog convertor 75 of FIG. 4, including the further signal modification circuit, including an analog processor. Referring to FIG. 7, the six output leads 101 from the recoder are applied to a resistive ladder network 121 by way of separate buffers 120. The buffers may be of the type CD 4041. The output of the resistive ladder network 121 is therefore an analog signal having a magnitude corresponding to the tone related to the depressed pads of the musical instrument. This analog voltage is applied by way of a buffer circuit 122, in the form of a voltage follower, to an inverting summer 323.

The junctions of a plurality of series connected resistors 123 are connected to separate terminals of a switch 124, the output of the switch being applied by way of a buffer 125, for example, of a type 301 operational amplifier, and range trimming resistor **125*a* to the input of an inverting summer 323. The inverting summer 323 and the range switch 124 enables the addition of selective predetermined voltages to the voltages applied thereto by way of the voltage follower 125. The trimmers in the circuit are set so that the voltages between positions of the range switch 124 correspond to an octave, whereby the range switch 124 may be employed to change the amplitude of the analog voltage in steps corresponding to an octave in the musical tone to be synthesized. The buffers 323 and 125 may be type 301**.

The output of the summing buffer 323 is applied to the summing buffer 126 by way of a varible voltage lag 127 and a buffer 128. The voltage lag 127 including a variable series resistor and a fixed shunted capacitor, and the buffer 128 constitute a controllable portamento circuit, in order to enable selectively varying the speed of response of the output with input changes, so that the portamento may be controlled.

The summing amplifier 126 has a bias normally applied by the variable resistor 131 to compensate for the offset potential. Alternatively, the switch 130 may apply a voltage from a potentiometer 132 to the summing amplifier 126. The potentiometer 132 thus adds a voltage to the analog voltage output of the amplifier 126, and this voltage may be preset, in order to enable transposing of the key of the output signal. In other words, the potentiometer 132 may be controlled so that determined increments of voltage appear at the output of the amplifier 126, so that the synthesizer may produce an output in a transposed key.

The output of the analog processing circuit, at the terminal 133, is applied to the music synthesizer, for the generation of the music tone. It is of course apparent that other effects may be provided by the circuit of FIG. 7. For example, low frequency oscillations may be introduced at the input of the summing amplifier 126, by a conventional oscillator, in order to produce a vibrato effect. The integration circuits of the portamento control introduces an RC time constant in the control voltage and the range switch 124 which may be on the musical instrument itself, introduces, for example, one or more steps in the output control for the transposition of octaves. A resistive ladder 121 is an R/2R ladder of a type well known in the art in which each switch output feeds through a resistor of value R2 into a ladder of resistors of value R; the ladder terminating at ground through a resistor of value R2. The value R may be any convenient resistance. When a digital 1 is present at any input, a non-zero voltage appears there and ground appears at every other input as explained. This enables the output of the digital to analog converter to vary logarithmically with the selected pitch of the instrument. The potentiometer 131 is set so that the lowest note to be played produces zero volts at the output terminal 133.

Figure 8:
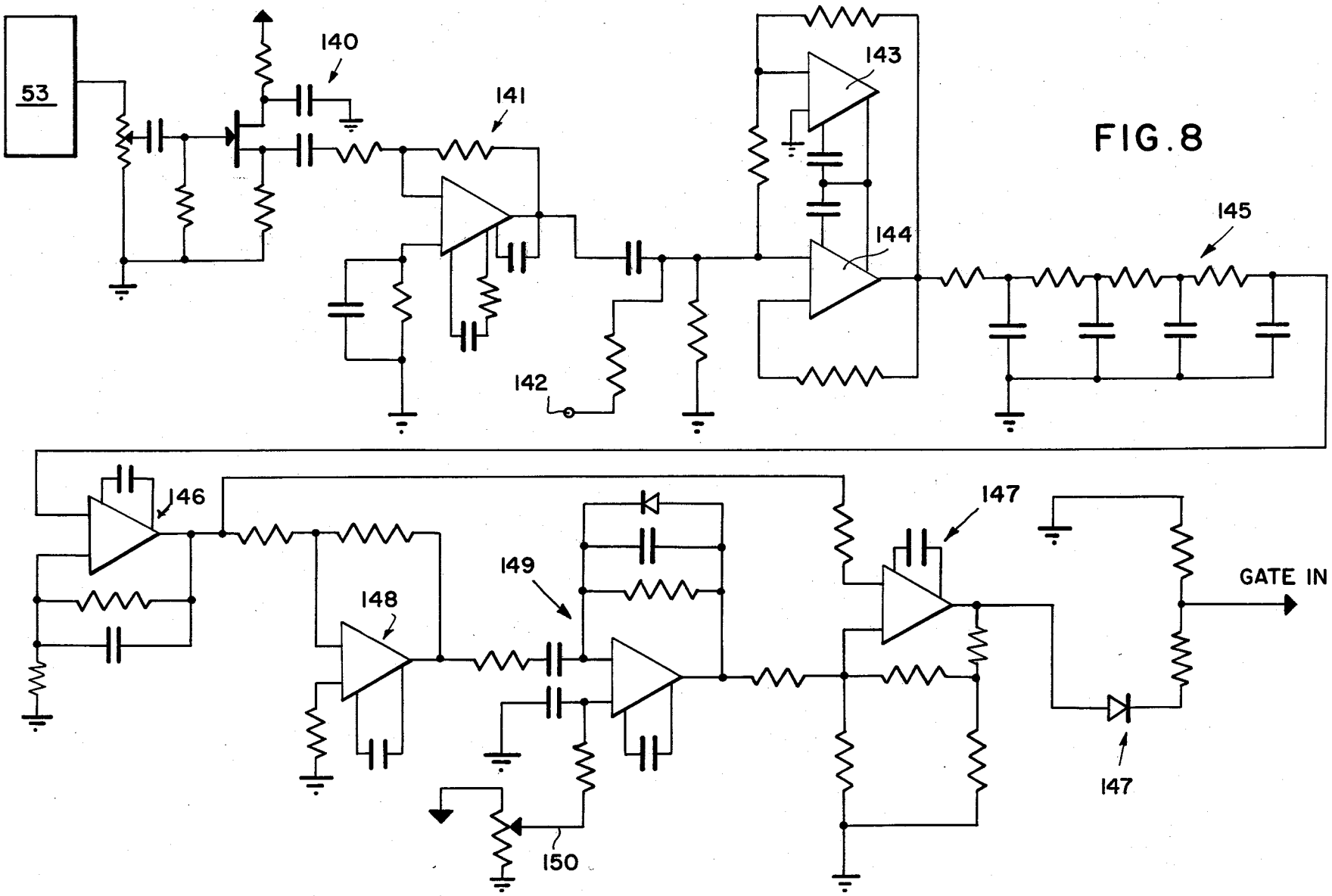
FIG. 8 is a circuit diagram of the "blow" control circuit of the system of FIG. 4.

FIG. 8 shows a circuit diagram for the production of the gate and trigger signals, for the "blow" mode. In this arrangement, the output of the transducer 53 is applied by way of source follower 140 to a preamplifier 141. If desired, an output terminal 142 may be provided at the output of the preamplifier 141. The output of the amplifier 141 is then rectified negatively by a pair of interconnected operational amplifiers 143 and 144, with the output of this rectifier being applied by way of a filter 145, to a noninverting amplifier 146. The filter 145 is essentially a low pass filter with a cut-off frequency of about 53 Hz.

The voltage at the output of the noninverting amplifier 146 therefore corresponds to the inverted envelope of the output of the transducer 53. The signal is applied as one input of a comparator 147, to produce the gate "in" signal corresponding to blowing of the instrument. The inverted envelope signal is also inverted to an inverter 148, and applied to a differentiator 149. The differentiator 149 provides a second input voltage for the comparator 147, whereby the inverted envelope is compared with the differentiated output of the differentiator 149. The voltage level at the output of the differentiator 149 is set by the reference potentiometer 150. The differentiator 149, thus biases the comparator 147, so that, whenever the input field increases in amplitude at the proper rate, the output of this circuit sees a momentary spike. The envelope signal and the differentiator 149 are processed by the comparator 147 so that, when one blows in the instrument, and the envelope signal exceeds the differentiated DC reference point, there will be made available a positive gate voltage. When the operator wishes to retrigger the gate by blowing harder, the spike at the differentiated output turns the comparator 147 off momentarily. The comparator 147 and differentiating circuit 149 thereby enables the circuit to be lipped, so that it is sensitive to changes in breath to vary the trigger points.

The gate "in" output of the circuit of FIG. 8 is applied to the corresponding terminal of the decoder as illustrated in FIG. 6, in order to enable the generation of the gate output signal in response to blowing of the instrument. In this instance, the switch S1A and switch S1B will be switched to the position not shown in the drawings. The gate signal will thereby be obtained directly from the output of the comparator 147, while the trigger signal will be generated from the gate signal due to the application of the gate output signal to the trigger pulse stretching network 111. It is to be noted that the switch S1 in the recoder allows the production of the gate signal by blowing in the "blow" mode, or by keying, in the "no blow" mode. The switch also permits the operator to hold the last note played by quickly removing the fingers from the instrument pads. In this mode of operation, the normal C sharp is produced by fingering the C sharp an octave lower, while pressing the octave key (key or pad 14).

It should be noted that in the arrangement of FIG. 8, the voltage output of inverter 148 has an amplitude which is related to the hardness to which the instrument is blown, so that this signal may ultimately be employed to control the intensity of the output signal of the synthesizer.

It is therefore apparent that in accordance with the present invention, a chromatic note-numbering system is established which also includes any desired alternate fingering for particular notes. Thus, as illustrated in FIG. 5, the terminal N16 is employed to provide alternatives when the instrument, such as a saxophone is fingered, and is not blown or is blown. It is evident that the circuit in accordance with the invention may be modified to suit other keyed or fingered wind instruments, clarinet, flute, for example, upon a similar chromatic matrix.

As discussed previously, it is not necessary to employ actual musical instruments in combination with controlled systems of the invention. Thus, as illustrated, in FIGS. 9–12, a simulated musical instrument, in accordance with the invention is comprised of, for example, a plastic tube 150. The tube may have a diameter, for example, of from one to one and one half inches, and a length of, for example, fifteen inches. The front of the instrument is illustrated in FIG. 9, with FIG. 10 illustrating the right-hand side, FIG. 11 illustrating the left-hand side, and FIG. 12 illustrating the back. The tube is provided with switches, corresponding to the saxophone pads as discussed previously, the switches are suitable placed by conventional means on the tube to enable their control by an operator. Thus, an operator may employ the device illustrated in FIGS. 9–12 for controlling the synthesizer, as an alternative to employing a saxophone or other wind instrument. It is to be noted that control switches 151 are illustrated on the back of the instrument in FIG. 12. These are the range switches, corresponding to switch 124 of FIG. 7, to enable the operator to control the octave of the reproduced signal. It will of course be apparent that a similar switch may be employed on an actual musical instrument.

Figure 13:
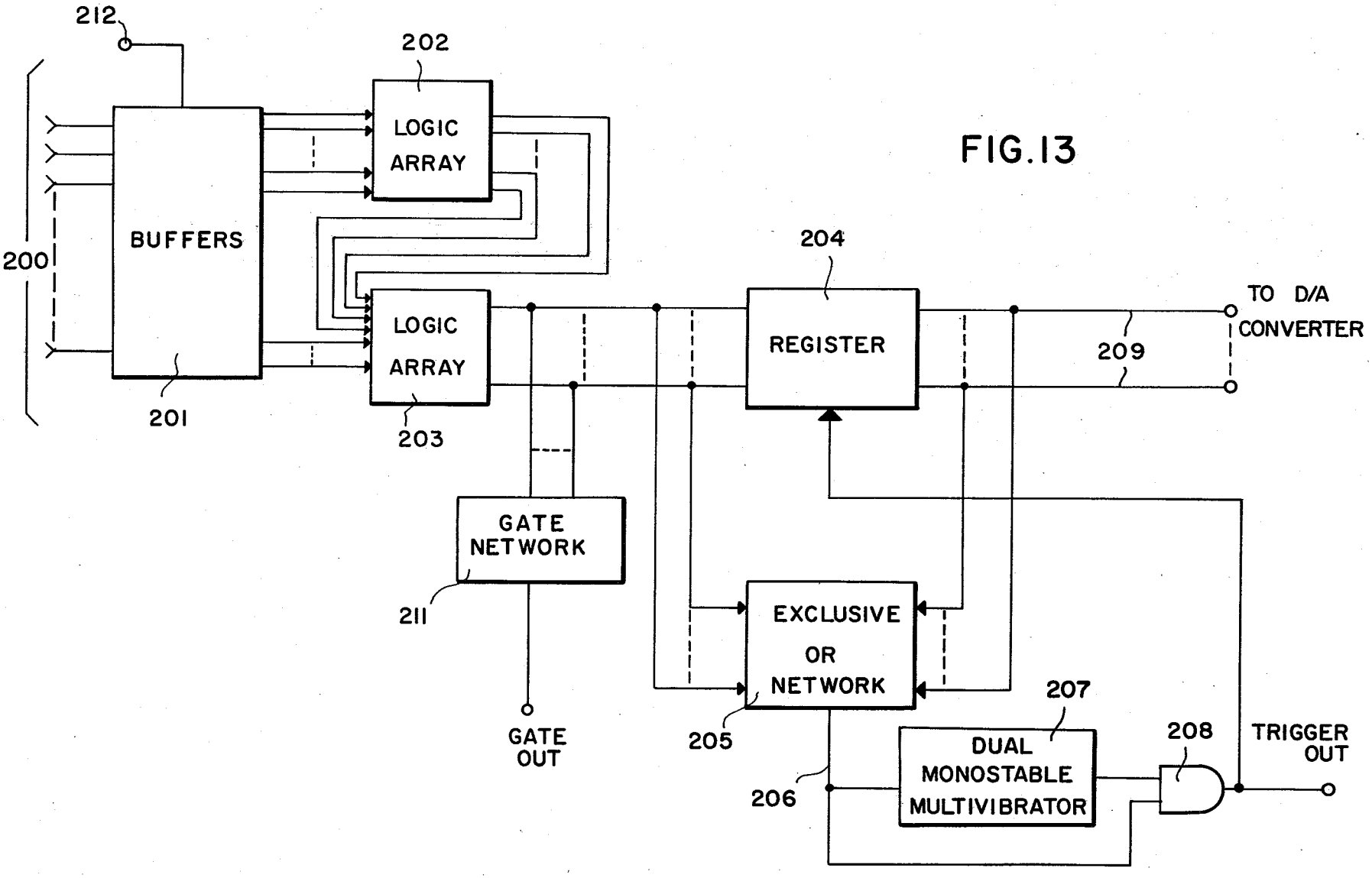
FIG. 13 is a block diagram of a modification of the decoder and recoder circuits of the arrangement of FIG. 4.

FIG. 13 illustrates a modification of the decoder and the recoder circuits of the invention, wherein the pads from the saxophone or other musical instrument are applied from the lines 200, by way of buffers 201 to field programmable logic array, circuits 202 and 203. In the illustrated embodiment of the invention two field programmable logic array circuits are employed, in view of the number of outputs of the buffers 201. For example, simple field programmable logic arrays that may be employed are Intersil type IM 5200, or signetics type 82S100. Since these devices usually have about 14 to 16 inputs, 14 of the outputs of the buffers 201 are applied to the input of the logic array 202, and the 8 bit output of the logic array 202 is applied to the first 8 inputs of the logic array 203. The remaining outputs of the buffers 201 are applied to the remaining inputs of the logic arrays 202 and 203. It will be recalled that a saxophone has about twenty pads; there are about twenty outputs from the buffers 201. If a programmable logic array is available having twenty inputs, then it may be employed in place of the pair of logic arrays 202 and 203.

A field programmable logic array of the type employed in the illustrated system comprises an integrated circuit that can be internally programmed to associate an 8 bit output word with a 14 bit input word. Thus, the logic array 202 provides an 8 bit output word corresponding to the fourteen pads of the saxophone and this 8 bit word in combination with the remaining six pads of the saxophone, enables the provision of an 8 bit word at the output of the porgrammable logic array 203, corresponding to the twenty pads of the saxophone. The 8 bit output of the logic array 203 thus corresponds in code form to the depressed pads of the saxophone, and is hence proportional in pitch to the desired output of the saxophone. The 8 bit output of the logic array 203 is connected to a register 204, and the inputs and outputs of the register 204 are applied to an exclusive OR network 205 to produce an output on a line 206 whenever the inputs and outputs of the register 204 are not the same. When the inputs and outputs are not the same, a pulse on the output lead line 206 triggers a dual monostable multivibrator 207, if the output of the line 206 is still present at the trailing edge of the output of the first monostable multivibrator, then the second monostable multivibrator and AND gate 208 will initiate a pulse to clock register 204 to delete data previously stored therein, and to store the data now appearing at the output of the logic array 203. The output of the AND gate 208 also provides the trigger output of the circuit. It is apparent that the multivibrator 207 may be set to have any desired delay in order to insure that the register 204 is not updated until there is positive disagreement between the inputs and outputs of the register 204, so that undesirable bounce effects are eliminated. The output lines 209 of the register 204 are applied to the inputs of the digital to analog converter, as illustrated in FIG. 7.

In order to determine whether or not pads in a saxophone have been depressed, indicating that a note is to be played, a gate network 211 is connected to the output lines of the logic array 203. The gate network 211 may be of two different types. In one case, the logic array is programmed so that, when no proper combination of pads are pressed, all of the outputs of the logic array 203 will have low logic levels, and the gate network 211 may be comprised of an OR gate having eight inputs connected to the separate eight outputs of the logic array 203. Alternatively, the logic array may be programmed so that all of the outputs of the logic array 203 are at logic high level when nonproper combination of pads on the saxophone are depressed to correspond to a note. In this instance, the gate network 211 may be comprised of an 8 input NAND gate, with the eight inputs being connected to separate outputs of the logic array 203.

The output of the gate network 211 thus comprises the gate output of the circuit, for application to the synthesizer.

In the arrangement of FIG. 13, it is apparent that the field programmable logic arrays may be programmed to do individual fingerings of different players. Thus, it is possible to accommodate custom fingerings. For example, if one plays a saxophone by his own method, which is not the usual method, it is possible to employ the circuit of FIG. 13 by merely plugging in differently programmed logic circuit arrays 202 and 203. This enables economical techniques for varying the program. It is apparent that, since available devices have fourteen input lines and eight output lines, the number of variations of the program is quite large. The field programmable logic arrays may either be programmed by the IC manufacturer or control system manufacturer, to suit the user's needs.

It is to be noted that the arrangement of FIG. 13 has the advantage in that it replaces the decoder, multiplexer and output register of the previously described arrangement, and that no address counter or clock is required. The preprogramming feature of the embodiment of FIG. 13 also adapts this arrangement for use with other wind instruments or custom instruments, such as for example, the simulated instrument of FIGS. 9–12. This feature also enables the adaptation of the system to nonblowing instruments, where suitable pad combinations correspond to the output of the device. The arrangement of FIG. 13 has a third advantage in that it results in the reduction of size of the control circuit.

The circuit of FIG. 13 is of course adapted for operation in the "no-blow" mode. In order to produce the gate signals in the "blow" mode, a circuit of the type illustrated in FIG. 8 may be employed, to produce the gate output signal, with a trigger output signal being generated in response to the gate output signal as illustrated in the circuit of FIG. 6.

For this purpose, conventional switching means may be employed to select whether the gate and trigger signals are derived from the circuit of FIG. 13, or from the "blow" circuit of FIG. 8.

A further input 212 may be provided for the logic array, by way of the buffers 201, for indicating to the circuit whether to operate in the "blow" or "no-blow" mode. The potential to this terminal 212 may be switched in synchronism with the switch employed for determining the origin of the trigger and gate signals. The field programmable logic array circuits are programmed to respond to the potential level at the terminal 212 in order to selectively manipulate the opening fingering to the specification of the user, without affecting the other notes.

While the invention has been disclosed and described with reference to a limited number of embodiments, it will be apparent that variations and modifications may be made therein. It is therefore intended in the following claims to cover each such variation and modification as falls within the sphere and scope of the invention.

TABLE 1

| LOGIC GATE | PADS AND COMPLEMENTS | KEY |
|---|---|---|
| N1 | 1, 13, 14A | $B^b$ |
| N2 | 1, 12, 14A | B |
| N3 | 1, 10A, 11, 14A | C |
| N4 | 1, 11, 14A | $C^\#/D^b$ |
| N5 | 1, 7, 8A, 9, 14A, Ground | D |
| N6 | 1, 8, 14A | $D^\#/E^b$ |
| N7 | 1, 6, 7, 14A | E |
| N8 | 1, 7, 14A | F |
| N9 | 1, 6, 14A | $F^\#/G^b$ |
| N10 | 1, 4A, 5, 14A | G |
| N11 | 1, 4, 14A | $G^\#/A^b$ |
| N12 | 1, 2, 3A, 14A | A |
| N13 | 1, 3, 14A, OR 14A, 20 Gd. | $A^\#/B^b$ |
| N14 | 2, 3A, 5A, 14A | B |

TABLE 1-continued

| LOGIC GATE | PADS AND COMPLEMENTS | KEY |
|---|---|---|
| N15 | 1, 14A | C |
| N16 | See Figure | C#/D^b |
| N17 | 1, 7, 8A, 9 | D |
| N18 | 1, 8 | D#/E^b |
| N19 | 1, 6, 7 | E |
| N20 | 1, 7 | F |
| N21 | 1, 6 | F#/G^b |
| N22 | 1, 4A, 5 | G |
| N23 | 1, 4 | G#/A^b |
| N24 | See Figure | A |
| N25 | See Figure | A#/B^b |
| N26 | 2, 1A, 14, 17A | B |
| N27 | See Figure | C |
| N28 | 14, 15A, 17A | C#D^b |
| N29 | 15, 16A, 17A | D |
| N30 | 16, 17A, 19A | D#/E^b |
| N31 | See Figure | E |
| N32 | 1, 3A, 17 | F |
| N33 | 1, 17 | F#/G^b |
| N34 | 6, 17 | G |
| N35 | Gd. (no gate) | G#/A^b |
| N36 | Gd. (no gate) | A |
| N37 | Gd. (no gate) | A#/B^b |
| N38 | Gd. (no gate) | B |
| N39 | Gd. (no gate) | C |

#signifies "sharp"
^bsignifies "flat"

Having described certain forms of the invention in some detail, what is claimed is:

1. In a system for synthesizing music including a plurality of selected operable switch means, a synthesizer at least responsive to analog input voltages for synthesizing tones of a frequency related to the amplitude of said analog input voltages, and control means responsive to operation of said switch means for producing said analog input voltages; the improvements wherein said control means comprises means responsive to the operation of said switch means for producing a binary coded signal proportional to a tone to be reproduced, said means for producing a binary coded signal being a decoder connected to said switch means and having a plurality of output lines each corresponding to a separate tone and recoder means responsive to the energization of said output lines for producing said binary coded signal, digital-to-analog converter means connected to convert said binary coded signal to an analog output signal, means applying said analog output signal to said synthesizer and said recoder means having means for scanning said output lines to provide a binary coded output signal corresponding to an output line having a signal thereon, said means for scanning including multiplexer means, a counter, clock means for continually stepping in said counter, the output of said counter being applied to said multiplexer for continually addressing said multiplexer to scan said output lines, and a means responsive to a coincidence between the address of said counter and an output line having a signal for recessing said counter, whereby the output count of said counter is a binary coded signal proportional to the tone to be synthesized.

2. The system of claim 1 further comprising first and second registers, means for continually updating the data stored in said first register with the output of said counter, and means responsive to a difference between the data stored in said first and second registers for updating the data stored in said second register, whereby the output of said second register comprises said binary coded signal.

3. The system of claim 2 wherein said means responsive to a difference in data comprises delay means, whereby said data stored in said first register is applied to said second register normally if said difference in data occurs for a predetermined period of time.

4. In a system for synthesizing music including a plurality of selectively operable switch means, a synthesizer at least responsive to analog input voltages for synthesizing tones of a frequency related to the amplitude of said analog input voltages, and control means responsive to operation of said switch means for producing said analog input voltages; the improvement wherein said control means comprises means responsive to the operation of said switch means for producing a binary coded signal proportional to a tone to be reproduced, digital-to-analog converter means connected to convert said analog output signal to said synthesizer, said means producing a binary coded signal including a decoder connected to said switch means and having a plurality of output lines each corresponding to a separate tone and a recoder means responsive to the energization of said output lines for producing said binary coded signal and means responsive to signals applied to said recoder for producing a trigger signal and a gate signal for said synthesizer.

5. In a system for synthesizing music including a plurality of selectively operable switch means, a synthesizer at least responsive to analog input voltages for synthesizing tones of a frequency related to the amplitude of said analog input voltages, and control means responsive to operation of said switch means for producing said analog input voltages, the improvement wherein said control means comprises means responsive to the operation of said switch means for producing a binary coded signal proportional to a tone to be reproduced, digital-to-analog converter means connected to convert said binary coded signal to an analog output signal, means applying said analog output signal to said synthesizer, and said control means containing programmable logic array means, means selectively connecting the inputs of said logic array means to said switch means, said logic array means being programmed to produce a binary coded output signal corresponding to a tone to be synthesized, a register connected to the output of said logic array means, and means responsive to differences between the output of said logic array means and the output of said register for updating data stored in said register in accordance with the data of said logic array means.

6. The system of claim 5 wherein said means responsive to difference in data comprises delay means for updating the data in said register only after a predetermined time following the detection of the difference in data.

7. The system of claim 5 further comprising gate means connected to the output of said logic array means for producing a gate signal for said synthesizer.

8. In a system for synthesizing music including a plurality of selectively operable switch means, a synthesizer at least responsive to analog input voltages for synthesizing tones of a frequency related to the amplitude of said analog input voltages, and control means responsive to operation of said switch means for producing said analog input voltages, the improvement wherein said control means comprises means responsive to the operation of said switch means for producing a binary coded signal proportional to a tone to be reproduced, digital-to-analog converter means connected to convert said binary coded signal to an analog output signal, said digital-to-analog converter including a resistive ladder network connected to receive said binary coded signal, whereby the output of said ladder network is an analog signal proportional to a tone to be synthesized, means applying said analog output signal to said synthesizer, and means for adding determined increments of voltage to the analog output signal of said digital-to-analog converter, whereby the octave of a tone corresponding to said analog output signal may be varied.

9. In a system for synthesizing music including a plurality of selectively operable switch means, a synthesizer at least responsive to analog input voltages for synthesizing tones of a frequency related to the amplitude of said analog input voltages, and control means responsive to operation of said switch means for producing said analog input voltages, the improvements wherein said control means comprises means responsive to the operation of said switch means for producing a binary coded signal proportional to a tone to be reproduced, digital-to-analog converter means connected to convert said binary coded signal to an analog output signal, means applying said analog output signal to said synthesizer, and integrating means for integrating said analog output signal to produce a portamento effect.

10. In a system for synthesizing music including a plurality of selectively operable switch means, a synthesizer at least responsive to analog input voltages for synthesizing tones of a frequency related to the amplitude of said analog input voltages, and control means responsive to operation of said switch means for producing said analog input voltages, the improvement wherein said control means comprises means responsive to the operation of said switch means for producing a binary coded signal proportional to a tone to be reproduced, digital-to-analog converter means connected to convert said binary coded signal to an analog output signal, means applying said analog output signal to said synthesizer, and means for adding selectively determinable voltages to said analog output signal whereby said analog output voltage corresponds to transposed tones.

11. In a system for synthesizing music including a plurality of selectively operable switch means, a synthesizer at least responsive to analog input voltages for synthesizing tones of a frequency related to the amplitude of said analog input voltages, and control means responsive to operation of said switch means for producing said analog input voltages, the improvements wherein said control means comprises means responsive to the operation of said switch means for producing a binary coded signal proportional to a tone to be reproduced, digital-to-analog converter means connected to convert said binary coded signal to an analog output signal, means applying said analog output signal to said synthesizer, and wherein said system is operable with a musical instrument including a transducer for producing a voltage corresponding to the intensity of the output of said instrument, further comprising means responsive to the output of said transducer for producing trigger and gate signals for said synthesizer.

* * * * *